United States Patent [19]

Wiebe

[11] Patent Number: 4,982,594

[45] Date of Patent: Jan. 8, 1991

[54] LOCATOR FOR A CRIMPING TOOL

[75] Inventor: Ulrich Wiebe, Döretrup, Fed. Rep. of Germany

[73] Assignee: C.A. Weidmuller GmbH & Co., Fed. Rep. of Germany

[21] Appl. No.: 435,300

[22] Filed: Nov. 9, 1989

[30] Foreign Application Priority Data

Nov. 11, 1988 [SE] Sweden ..... 8804084

[51] Int. Cl.[5] ..... B21D 7/06; B21D 43/26

[52] U.S. Cl. ..... 72/416; 72/412; 72/410; 72/461

[58] Field of Search ..... 72/412, 416, 410, 409, 72/461; 81/421, 418, 9.4, 9.44; 29/751

[56] References Cited

U.S. PATENT DOCUMENTS

| | | | |
|---|---|---|---|
| 2,359,083 | 9/1944 | Carlson | 72/410 |
| 3,199,334 | 8/1965 | Holmes | 72/410 |
| 3,252,316 | 5/1966 | Haucke | 72/410 |
| 3,281,926 | 11/1966 | Frastaci | 72/410 |
| 3,457,764 | 7/1969 | McKee | 72/410 |
| 3,710,611 | 1/1973 | Filia | 72/410 |

*Primary Examiner*—Daniel C. Crane

*Attorney, Agent, or Firm*—Cushman, Darby & Cushman

[57] ABSTRACT

A locator for a crimping tool is provided with a grip element accommodating an electrical connector for each pair of dies. The grip elements(s) is (are) carried by a carrier block means which is rectilinearily movable between a stand-by position, in which with the aid of a lever and a slanting track the grip element(s) is (are) located in the area between the open jaws of the crimping tool (10), and a rest position, in which they are located completely outside this area.

15 Claims, 3 Drawing Sheets

LOCATOR FOR A CRIMPING TOOL

FIELD OF THE INVENTION

The present invention relates to a locator for a crimping tool. By "crimping tool" is meant a hand tool or a stationary apparatus for crimping electrical terminals or connectors such as cable shoes or the like in order to affix them on stripped ends of electrical conductors.

A crimping tool is provided with two jaw carriers which are movable toward one another and away from one another, and on each of which is an operative die mounted which is provided with one or more die elements, each die element defining together with the juxtapposed die element on the other jaw carrier a co-operating pair for crimping an inserted connector.

By "locator" is understood an additional device on the crimping tool which has the purpose to position correctly the connector in the die pair.

BACKGROUND OF THE INVENTION

A known locator device, enabling to set two different positions, is described in Assignee's European patent application No. 125 708. The object of the present invention is in particular to provide a locator for small crimpable contacts, including plugin tabs and socket parts. By "small crimpable contact" is a connector understood which has a size usual e.g. in the low current and/or telecommunications field.

It is an object of the invention to provide a locator (for only one position) which has simple construction, and in which the connector is stably retained in the desired crimping position and—considering its small dimensions—also in a very precise manner.

This object is achieved with a locator having the features according to the enclosed claim 1, preferred further development being indicated in the subclaims.

SHORT DESCRIPTION OF THE DRAWINGS

The invention shall now be explained more in detail with the aid of the enclosed drawings, which refer to exemplary embodiments, and in which FIG. 1 is a perspective view of a first embodiment of a locator according to the present invention affixed to a pair of crimping pliers and in rest position;

DETAILED DESCRIPTION OF THE INVENTION

Figure 1:
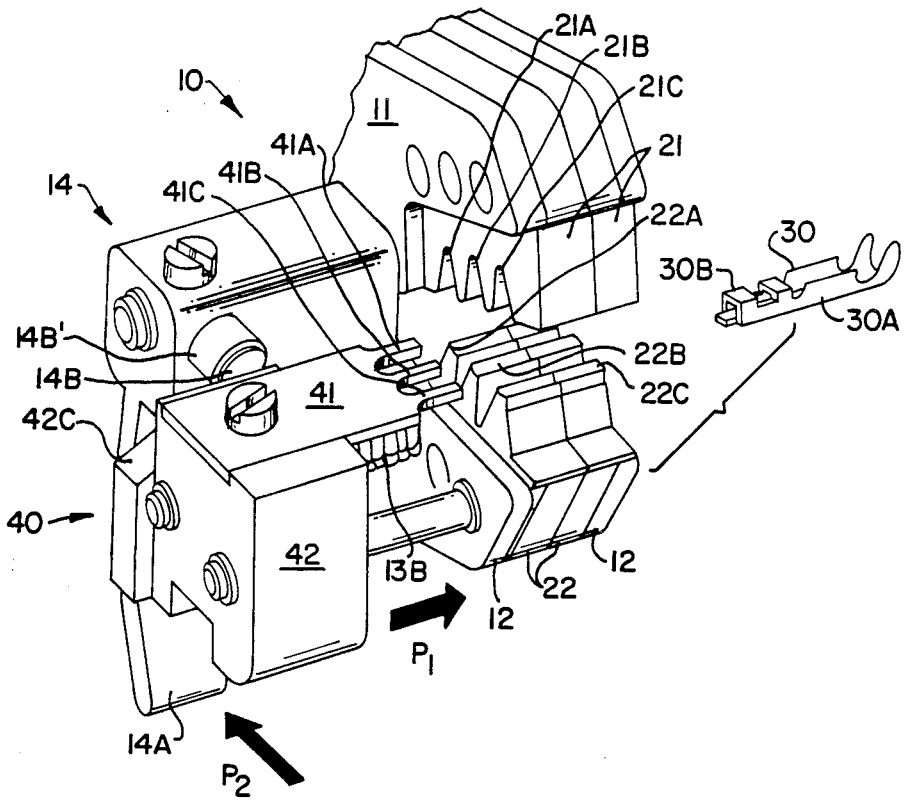
Figure 3:
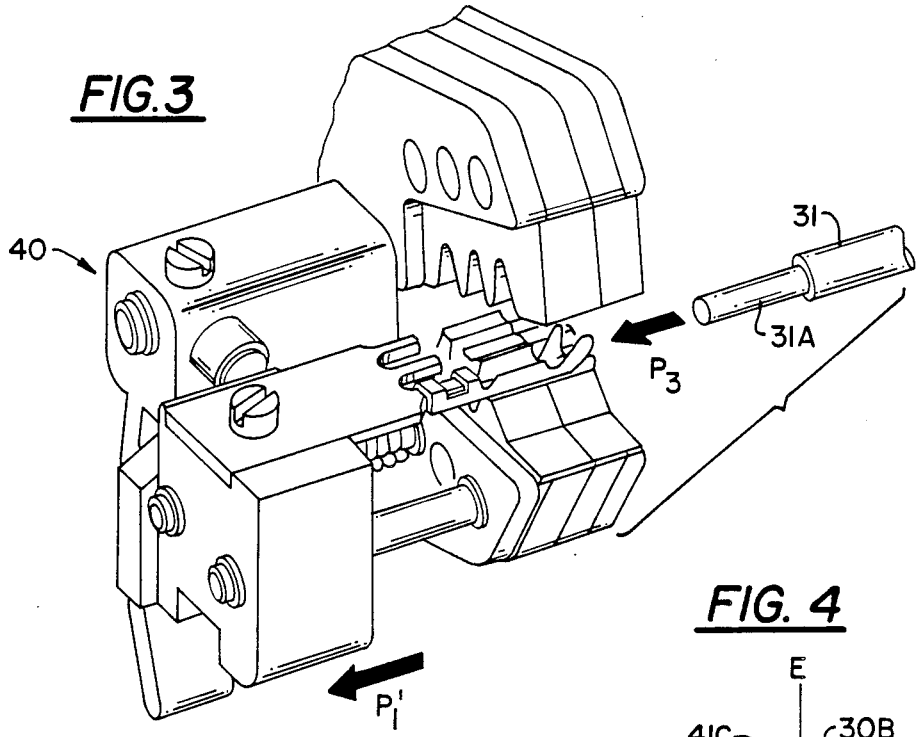

According to FIG. 1, a pair of pliers 10, not shown more in detail, is provided with two jaw carriers 11, 12 which each carry in the interspace between their two shanks a jaw 21, 22 (which consist of two parts in the example shown). Each jaw has, in a manner known per se, three die elements 21A, 21B, 21C and 22A, 22B, 22C respectively. Two juxtapposed die elements such as 21A/22A etc. define a co-operating pair, in which a connector 30 shall by crimping be mechanically affixed to the stripped end 31A of an electrical conductor 31 (FIG. 3)

The connector 30 consist of an attachment or ferrule part 30A, which in known manner is adapted for mechanical attachment to an electrical conductor 31, i.e. by being crimped thereon, and of a contact part 30B (which is hollow in the example shown) for establishing electric contact with another connector. The direction, in which the electrical conductor 31 may be inserted into the connector 30 is in the present description called "axial direction".

A locator 40 according to the present invention is mounted at one side of the jaw carrier 12 (the lower one in the drawing) so as to be rectilinearily movable in the sense of the arrows $P_1$ (FIG. 1) and $P_1'$ (FIG. 3) toward and away from the jaw carrier 12. For each die pair such as 21A/22A is the locator 40 provided with a grip element extending toward the die pair and adapted to hold fast the respective connector. In the example shown, the grip elements are embodied by fingers 41A, 41B, 41C, whose cross-section (see FIG. 3) corresponds to that of the hollow in the contact part 30A of the connector, or which at least does not exceed this cross-section.

The fingers 41A to C are in a side by side position carried by a plate 41, or are manufactured integral with this plate as parts thereof. The plate 41 is in its turn carried by a carrier block means 42 in which are two through-openings provided, with the aid of which the block is slidably mounted on a guide bar means having a first end for attachment to the crimping tool, and on opposite end, and embodied in two guide bars 13 (FIG. 3), anchored at their first ends in the jaw carrier 12. It will be appreciated that the two guide bars 13 also may be replaced by a single guide bar, e.g. with rectangular cross-section.

The plate 41 and the carrier block means 42 are rectilinearily movable in the axial direction of the connectors. The guide bars 13 are at their second ends provided with end stop means 13A (FIG. 2) which define a rest position of the carrier block means 12, and thus of the whole locator 40.

On the rear side (i.e. the side which is more remote from the free end of the jaw carrier 12) of the block means 12 is a slanting guiding track means or ramp 42C provided which rises in the direction toward the jaw carrier 12. A slanting track **42*c* is comprised in a plane which is parallel with the path P; of the carrier block means 42, for example with the guide bar means 13. A lever means 14 is pivotally mounted on the pair of crimping pliers 10, preferably on the pin (not shown) by which the two jaw carriers 11, 12** are interconnected, or more correctly, on an extension thereof. The laid track and lever means embody a driving means for the carrier block means.

The lever means 14 has a lever part 14A and an engagement means embodied by a tap 14B which bears against the guiding track 42C. A spring, not shown, may constantly urge the lever means 14 in such a pivotal position, in which the engagement tap 14B (which preferably carries a rotable sleeve 14B') is pressed against the guiding track 42C.

A compression spring 13B, slipped on at least one of the guiding bars 13B, urges constantly the carrier block means 42 into the rest position shown in FIG. 1. The grip elements 41A to C are only so long as to end, in this rest position, ahead of the area of the jaws 21, 22 and of the jaw carriers 11, 12.

Figure 2:
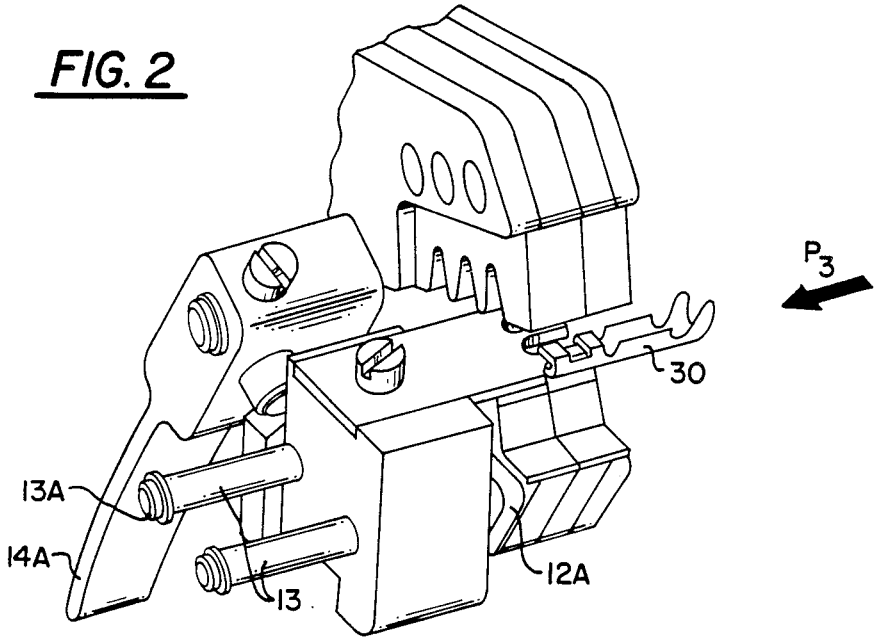
FIGS. 2 and 3 show the same locator in two operative steps.

The device according to FIGS. 2 to 5 operates as follows. In the open position of the jaw carriers 11, 12 and of the jaws 21, 22, shown in FIG. 1, is the lever part 14A of the lever means 14 maneuvered in the sense of arrow $P_2$, whereby, due to co-operation of the engagement tap 14B with the guiding track 42C, the block 42 is brought into a stand-by position, at the first end of the guide bar means, i.e. closest to the jaw carrier 12, as shown in FIG. 2.

In this stand-by position, the grip elements 41A to C are located in the space between the open jaws 11, 12, so as to be readily accessible from the opposite side of the tool than where the locator is placed. On that grip element 41, which cooperates with the selected die pair 21C/22C, is a connector 30 placed (in the example shown, slipped-on on the finger 41C) so as to be retained by the grip element. Then is the lever part 14A released, and the spring 13B brings the carrier block means 42 back into the rest position (FIG. 3).

Figure 4:
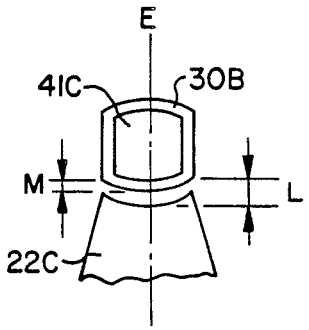
FIG. 4 shows a detail at a larger scale.

In contrast to the situation shown in FIG. 1, a connector 30 occupies now exactly that position relative the die element 22C in that jaw carrier 12, to which the locator 12 is attached, in which the connector shall be attacked or affected by this die element when the two jaws 11, 12 are being closed. In this position, which henceforward will be called "desired position", is the contact part 30A located completely outside, and the attachment part 30 completely inside the operative area of the pair of die elements 21C/22C, the connector 30 being at the same time, as shown in FIG. 4, exactly centered relative the die element 22C (common plane of symmetry E).

The grip elements, such as the fingers 41A to C, are in height direction so located relative the guide bar 13, when the locator is mounted on the crimping tool and brought into its stand by position, that an air gap L is obtained between them and the respective die elements A to C, which is slightly larger than the thickness M of the material of the connector 30, so that in the situation according to FIG. 3, the connector may be readily slipped on, and will not be stripped-off, when the locator is brought back into the starting position.

Figure 5:
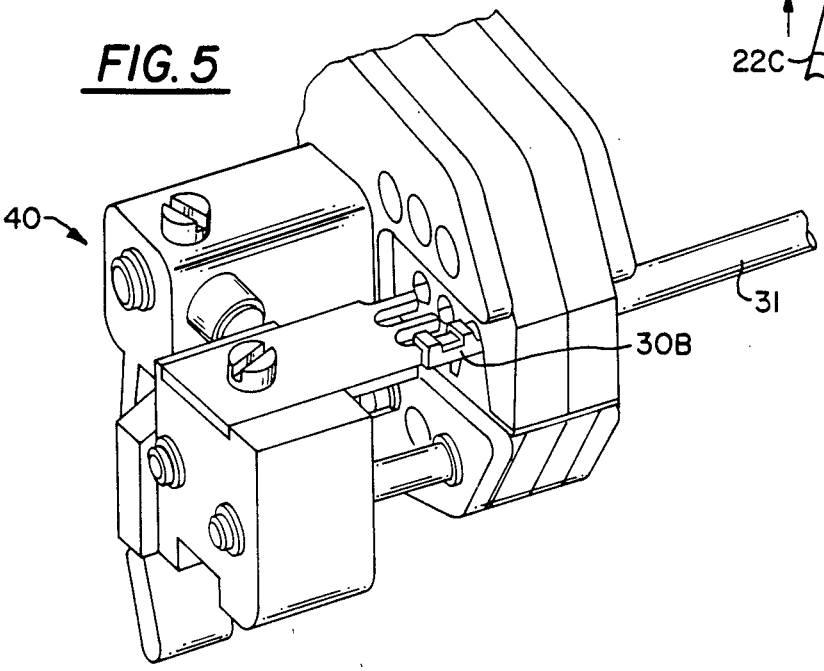
FIG. 5 shows the same locator in a third operative step.

In this position (or possibly already in the position according to FIG. 2), the conductor 31 is according to FIG. 3 in the sense of arrow $P_3$ inserted with its stripped end 31A into the connecting part 30B, whereupon the pair of crimping pliers is operated in the usual way, so as to in per se known manner crimp the attachment part 30B in the position according to FIG. 5. Then is the pair of jaws 21, 22 opened, and the conductor 31 is together with the connector 30 removed from the pair of pliers 10 and from the locator 40, whereby a situation according to FIG. 1 is re-established.

Figure 6:
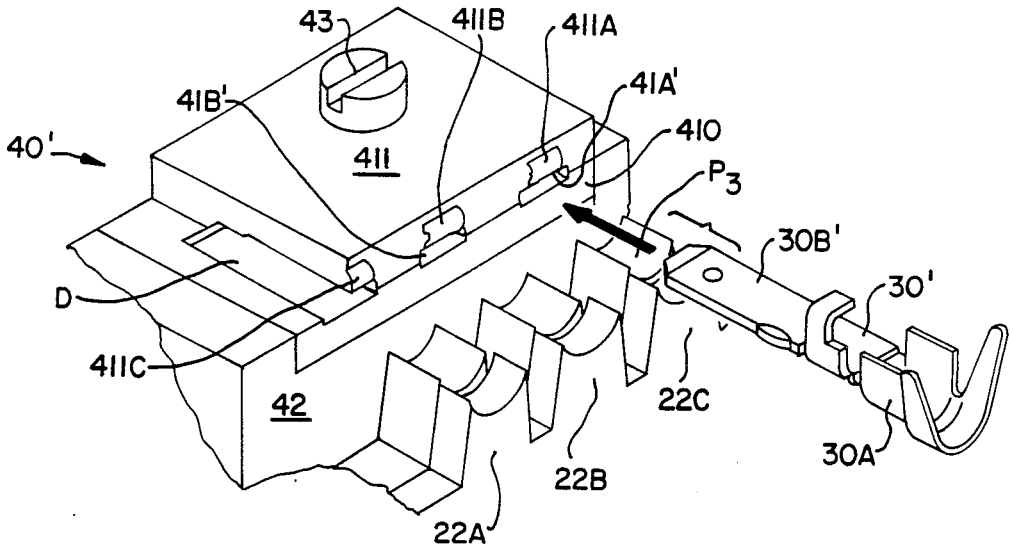
FIGS. 6 and 7 show a second and a third embodiment of the locator according to the invention.
Figure 7:
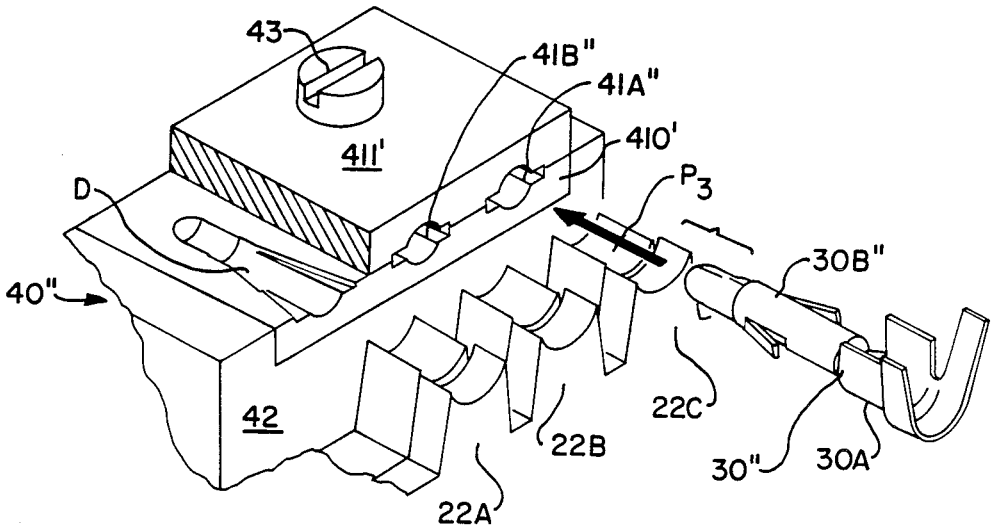

In FIGS. 6 and 7 are shown two embodiments 40' and 40" of the locator according to the invention for connectors 30' and 30" respectively whose attachment parts are not hollow, so that they cannot receive any fingers such as 41A etc. The grip elements are therefore defined by openings such as 41A', 41B' or 41A", 42A" in which the contact parts 30', 30" may accommodated, preferably in a resilient manner. The block 42 carries instead of the plate 41 two co-operating thicker plates 410, 411 or 410', 411', in which there are provided recesses corresponding to the respective openings. The plates 411, 411' are for clarity partly broken-off so as to make the recesses in the A-position visible.

The contact parts 30B" (FIG. 7) are themselves provided with resilient elements, so that such elements need not be provided in the openings 41A" etc. As this is not the case with the contact parts 30B' (FIG. 6), are the openings 41A' etc. provided with springs 411A, 411B and 411C.

The plates 410, 411 and 410', 411' respectively are affixed to the block 42 by screws 43, and they may preferably be exchangeable by several sets of plates having identical outer dimensions.

It will be recognised that even other embodiments than those, which are illustrated, are possible. E.g. the carrier means of the grip elements, and/or the drift of this means, may be executed in a different manner. The plate 41 may e.g. be bent downwardly with 90°, and/or the guiding bars 13 may pass through sleeves welded adjacent the openings in the bent part.

What is claimed is:

1. A locator for a crimping tool with a pair of jaw carriers movable toward and apart from one another, a pair of jaws mounted in said pair of carriers and each comprising at least one die element, juxtaposed die elements of said pair of jaws defining a pair of dies co-operating for crimping on electrical conductor connectors which have an attachment part and contact a part, the locator member comprising in combination:

guide bar means having a first end and a second end and attachable at said first end to one side of one of said jaw carriers;

carrier block means mounted for reciprocal movement along said guide bar means between a stand-by position adjacent said first end of said guide bar means and a rest position;

one grip element provided for each said pair of co-operating dies mounted on said carrier block means and extending toward said respective die pair;

a guide track member firmly attached to said carrier block means and extending along one side thereof, said guide track member being inclined upwardly in a direction towards said first end of said guide bar means; and lever means pivotally mounted to said crimping tool and comprising an engagement means bearing against said guide track member whereby upon movement of the lever member, the carrier block is moved from said rest position, in which each grip element is located completely outside the jaw area, and brought into said stand-by position, in which each grip element is located in a space between said jaws.

2. Locator according to claim 1, wherein a spring means constantly urges the engagement means of lever means into engagement with the guide track member.

3. Locator according to claim 1, wherein end stop means are provided at said second end and a compression spring means constantly urges the carrier block means into said rest position.

4. Locator according to claim 1, wherein each grip element is embodied by a finger with a cross-section which does not transgress the cross-section of a hollow in the attachment part of a connector, so that the connector may by this contact part be slipped on the grip element.

5. Locator according to claim 4, wherein each grip element is in height position so located relative the guide bar means, that in the stand-by position of the locator an air gap is obtained between a connector, carried by the grip element and the respective die, which is greater than the thickness of the material of the connector.

6. Locator according to claim 4, wherein each finger is carried by a plate affixed to the carrier block means.

7. Locator according to claim 6, wherein the plate is mounted on the carrier block means in a readily exchangeable manner.

8. Locator according to claim 1, wherein each grip element is embodied by an opening in which a non-hollow contact part may be accommodated.

9. Locator according to claim 8, wherein the opening is adapted for the reception of a non-resilient contact part by being provided with a spring element.

10. Locator according to claim 8, wherein each opening is embodied by two co-operating recesses in two adjacent plates which are mounted on the carrier block means.

11. Locator according to claim 8, wherein the two plates are mounted on the carrier block means in a readily exchangeable manner.

12. Locator according to claim 1, wherein the guide bar means are embodied by two parallel guide bars, the carrier block means having openings through which said bars pass, at least one guide bar having an end stop means at its second end, and a compression spring means mounted on at least one guide bar which constantly urges the carrier block means toward said end stop means.

13. Locator according to claim 1, wherein the engagement means is embodied by an engagement tap on which a readily rotatable sleeve is mounted.

14. Locator according to claim 1, wherein the lever means is mounted on an extension of a pin with which the two jaw carriers are interconnected.

15. A locator for a crimping tool with a pair of jaw carriers movable toward and apart from one another, a pair of jaws mounted in said pair of carriers, and each of which comprises a plurality of die elements, juxtaposed die elements in the two jaws defining pairs of dies co-operating for crimping on electrical conductor connectors which have an attachment part and a contact part, the locator member comprising, in combination:

at least one guide bar having a first end and a second end and attachable at the first end to one side of one of the jaw carriers;

carrier block means surrounding said guide bar and reciprocally movable along said guide bar between a stand-by position adjacent said first end, and a rest position;

a plurality of grip elements, corresponding to the number of die pairs, mounted side by side on said carrier block means and extending toward the respective die pairs;

manually operable driving means for moving the carrier block means from its rest position, in which each grip element is located completely outside the jaw area, into the stand-by position, in which each grip element is located in the space between the open jaws, each grip element being disposed in height position relative to the guide bar such that in the stand-by position of the locator an air gap, greater than the thickness of the material of the connector, is obtained between the respective die and a connector carried by the grip element, so that the juxtaposed dies surround the locator to define said air gap.

* * * * *